United States Patent [19]

Coffee

[11] Patent Number: 4,962,885

[45] Date of Patent: Oct. 16, 1990

[54] PROCESS AND APPARATUS FOR SPRAYING LIQUID

[76] Inventor: Ronald A. Coffee, Thursley Copse, Farnham Lane, Haslemere, Surrey, United Kingdom

[21] Appl. No.: 425,431

[22] Filed: Oct. 24, 1989

Related U.S. Application Data

[63] Continuation of Ser. No. 323,234, Mar. 14, 1989, abandoned, which is a continuation of Ser. No. 579,074, Feb. 10, 1984, abandoned, which is a continuation of Ser. No. 30,757, Apr. 17, 1979, abandoned.

[30] Foreign Application Priority Data

Apr. 17, 1978 [GB] United Kingdom ..... 78-14967

[51] Int. Cl.[5] ..... B05B 5/02

[52] U.S. Cl. ..... 239/3; 239/690

[58] Field of Search ..... 361/225–228, 361/235; 118/621, 624, 626; 239/3, 690, 708

[56] References Cited

U.S. PATENT DOCUMENTS

| | | | |
|---|---|---|---|
| 1,958,406 | 5/1934 | Darrah | 118/626 X |
| 2,658,009 | 11/1953 | Ransburg . | |
| 2,955,565 | 10/1960 | Schotland | 118/626 X |
| 3,195,264 | 7/1965 | Ward, Jr. | 239/706 |
| 3,287,614 | 11/1966 | Sowiak | 361/235 |
| 3,336,903 | 8/1967 | Point | 118/624 |
| 3,393,662 | 7/1968 | Blackwell . | |
| 3,540,653 | 11/1970 | Fabre . | |
| 3,677,470 | 7/1972 | Probst et al. . | |
| 3,951,340 | 4/1976 | Point . | |

FOREIGN PATENT DOCUMENTS

| | | | |
|---|---|---|---|
| 26979 | 9/1967 | Australia . | |
| 28495 | 5/1971 | Australia . | |
| 35427 | 11/1971 | Australia . | |
| 553132 | 3/1973 | Australia . | |
| 1677171 | 6/1960 | Fed. Rep. of Germany . | |
| 1156341 | 10/1963 | Fed. Rep. of Germany | 118/626 |
| 1162728 | 2/1964 | Fed. Rep. of Germany | 239/690 |
| 2534776 | 4/1975 | Fed. Rep. of Germany . | |
| 2731712 | 7/1977 | Fed. Rep. of Germany . | |
| 2358207 | 7/1977 | France . | |
| 30665 | 2/1975 | Japan . | |
| 13651 | 2/1977 | Japan . | |
| 129745 | 4/1977 | Japan . | |
| 527768 | 9/1969 | Switzerland . | |
| 568466 | 7/1974 | U.S.S.R. . | |
| 640751 | 3/1976 | U.S.S.R. . | |
| 601054 | 4/1978 | U.S.S.R. | 239/706 |
| 749008 | 4/1953 | United Kingdom . | |
| 923392 | 5/1960 | United Kingdom . | |
| 1193252 | 7/1967 | United Kingdom . | |
| 1394984 | 3/1972 | United Kingdom . | |
| 1569707 | 6/1980 | United Kingdom . | |

*Primary Examiner*—Andres Kashnikow

*Attorney, Agent, or Firm*—Cushman, Darby & Cushman

[57] ABSTRACT

A process and apparatus for spraying liquid at a target, which comprises atomizing liquid by charging it electrostatically, projecting the charge atomized liquid on a path toward the target and at least partially discharging the charged particles so formed with an ionic discharge induced by the particles as they pass an earthed electrode having a sharp or pointed edge sited adjacent said path.

8 Claims, 3 Drawing Sheets

PROCESS AND APPARATUS FOR SPRAYING LIQUID

This is a continuation of application Ser. No. 07/323,234, filed Mar. 14, 1989, which is a continuation of Ser. No. 06/579,074, filed Feb. 10, 1984, which is in turn a continuation of Ser. No. 030,757, filed Apr. 17, 1979, all now abandoned.

The present invention relates to a process and apparatus for spraying liquid, and in particular to forming sprays of liquid electrostatically. It has particular but by no means exclusive application to the spraying of crops and to paint spraying.

In British Patent Specification No. 1569707 there is described a device which may be used to form a fine spray of electrically charged liquid particles. It comprises a conductive nozzle charged to a potential of the order of 1–20,000 volts, closely adjacent which is an earthed electrode. The field which arises between the nozzle and the earthed electrode is sufficiently intense to atomise liquid delivered to the nozzle, and thereby produce a supply of fine charged liquid droplets; but the field is not so intense as to cause corona discharge, with resulting high current consumption. One embodiment of the invention is a hand-held sprayer for agricultural use which has significant advantages over known hand-held sprayers employing an electrically driven rotating disc to produce spray. Such advantages are in power consumption and hence battery use, in potentially improved reliablility due to the absence of moving parts, and in particular in producing a charged spray which is attracted to crop plants and gives more even coverage thereon.

The last-named property can have drawbacks in some circumstances. For example, it is occasionally required to form a cloud of droplets which drift onto crops. In these circumstances, a cloud of charged droplets may be too easily attracted to the nearest foliage and not penetrate the crop sufficiently.

It is a further advantage of the device described in British Patent Specification No. 1569707 that it may be used to produce particles of controlled size. The mean radius of particles produced by the device is smaller the greater their charge-to-mass ratio; hence the mean radius may be controlled by varying the strength of the atomising field (which is very conveniently carried out by varying the voltage). However, it may be that, in some circumstances, particles of the optimum size for a particular application are found to be too highly charged. This may give rise to too strong repulsive forces between them (so that, for example, a non-conductive spray target does not receive a thick enough coating) or it may result in plants being too heavily coated on sharp points and edges. Corresponding difficulties may arise in other areas of application.

It may thus be desirable to discharge, wholly or partly, liquid droplets which have been produced by electrostatic atomisation. The present invention provides a convenient way of doing this.

According to the present invention we provide a process for spraying liquid, which comprises atomising liquid by charging it electrostatically, and at least partially discharging the charged particles so formed with an ionic discharge induced by the particles as they pass an earthed electrode having a sharp or pointed edge.

We further provide apparatus for carrying out the process of the invention which comprises:

means for supplying liquid to an atomisation site;

means for charging liquid at the site sufficiently to cause it to atomise into charged droplets and be projected on an outward path; and an earthed electrode having a sharp or pointed edge or edges adjacent to and directed toward or along the path of the droplets.

It is preferred that the liquid be atomised by apparatus of the kind described in British Patent Specification No. 1569707. It is often desirable to be able to control the induced current from the earthed electrode or electrodes and hence the degree to which the charged droplets are discharged. This may be done in various ways, including varying the distance of the sharp or pointed edges from the path of the droplets, and their attitude with respect to it. A particularly convenient method is to shield the sharp or pointed edges with earthed sheath electrodes, the edges being adjustably retractable into the sheaths, e.g. by a screw mechanism.

Some embodiments of the invention will now be described, by way of example, and with reference to the accompanying drawings in which.

Figure 1:
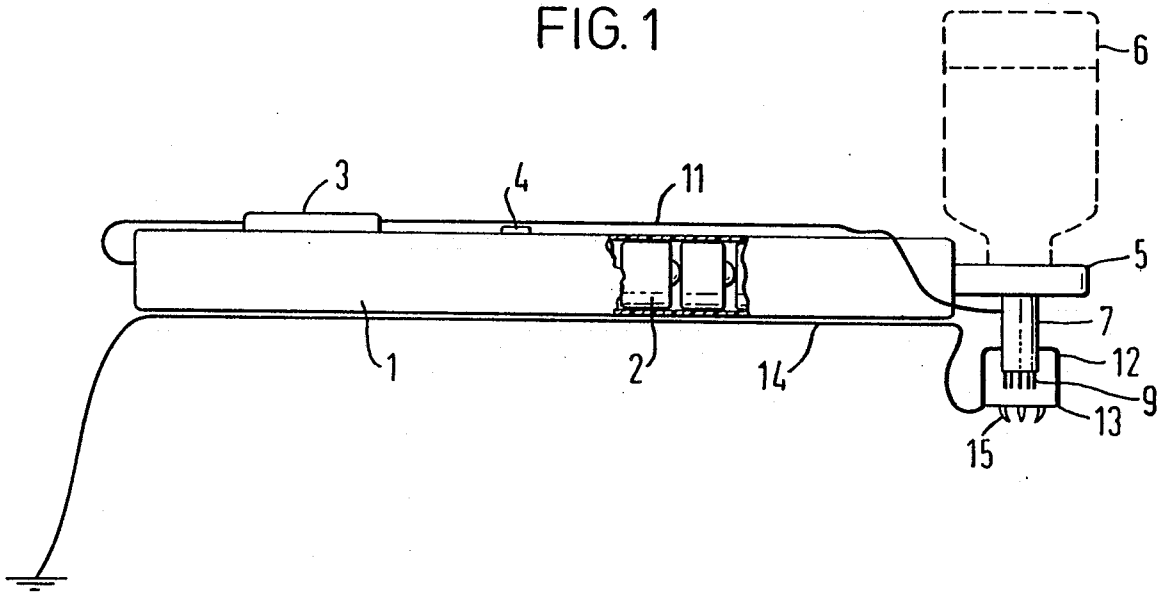
FIG. 1 is a view in elevation schematically illustrating the main components of a sprayer according to the invention.
Figure 2:
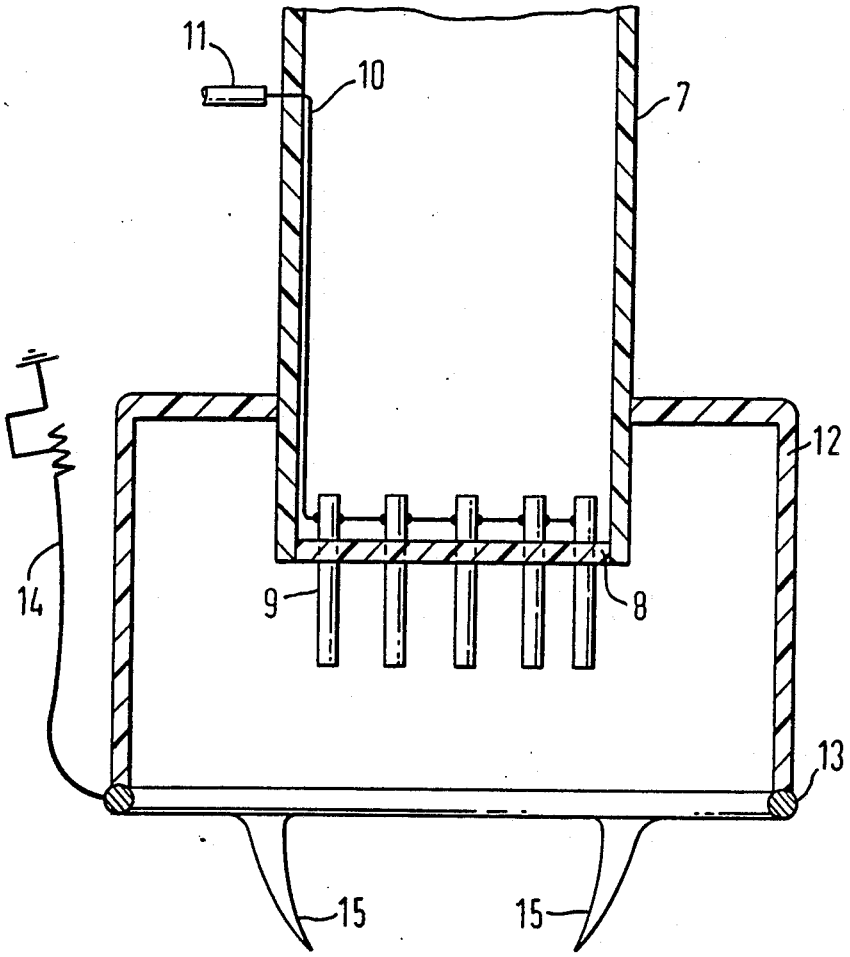
FIG. 2 is a cross-section of the sprayer nozzle shown in FIG. 1.

Referring to FIGS. 1 and 2, the electrostatic sprayer comprises a hollow tube 1 formed of a plastics material and providing a firm holding support for other parts of the sprayer. Within the tube 1 is a bank of sixteen 1½ volt batteries 2 which acts as the electrical energy source. Attached to the side of the tube 1 is a Brandenburg 223P (0–20 KV, 200 microamp) high voltage module 3 connected to the batteries 2 and to a 'ON-OFF' switch 4, and providing a source of high electrical potential. The tube 1 at its forward end has an integral, internally screw-threaded eye 5 adapted to receive a bottle 6 containing liquid to be sprayed. The eye 5 at its lower part holds the upper part of a tubular distributor 7 formed of an insulating plastics material and supporting in its lower end a disc 8 (FIG. 2) of the same material. Now, referring more specifically to FIG. 2, projecting through the disc 8 are eight metal capillary tubes 9 which form the spray nozzle assembly. The capillary tubes 9 are each soldered to a bare-metal wire 10 which in turn is connected to the high potential terminal of the module 3 via a high potential cable 11.

Encircling the distributor 7 is an inverted dish 12 formed of an insulating plastics material. Supported in the lip of the dish 12 is a metal field-adjusting ring member 13 electrically connected to earth by an earth lead 14. Formed integrally with the ring 13 are three metal needles 15 spaced equally around it, pointing outwardly along and slightly towards the axis of the tubular distributor 7. The dish 12 may be moved up and down the distributor 7 but fits sufficiently closely thereon to maintain by frictional engagement any position selected.

To assemble the sprayer for use, the bottle 6, containing liquid to be sprayed, is screwed into the eye 5 while the sprayer is inverted from the position shown in FIG. 1. Inverting the sprayer back to the position shwon in FIG. 1 allows th liquid to enter the distributor 7 and to drip out of the capillary tubes 9 under gravity flow.

In operation to spray liquid, the sprayer is held by hand at a suitable position along the length of the tube 1.

On turning switch 4 to its 'ON' position, the capillary tubes 9 become electrically charged to the same polarity and potential as the output generated by the module 3. This results in the liquid emerging from the tubes electrostatically charged when the sprayer is inverted to the spraying position. The charged liquid is caused by the action of the electrostatic field to form short mobile ligaments which break up at their tips into fine spray. As the spray passes the needles 15, it induces on them a sufficient electrical potential of opposite sign to cause corona discharge from the needle tips onto the spray, thereby substantially reducing or even in some circumstances eliminating the charge on the spray.

The field-adjusting member 13 being earthed, via earth lead 14, the electrostatic field at and around the capillary tubes 9 improves both the atomisation and the spray pattern even when the potential on the spray nozzle assembly is at only, say, 10 to 15 kilovolts (either positive or negative polarity with respect to the field adjusting member 13). Furthermore, due to the close proximity of the field adjusting member 13 to the spray nozzle assembly, the current drawn from the source of high potential 3 is mainly that which arises from an exchange of charge between the capillary tubes 9 and the liquid being sprayed, and is thus extremely small.

Typically, the charge density of the atomised liquid is $5\times10^{-3}$ coulomb per liter. Thus, at a liquid flow rate of, say $1\times10^{-3}$ liter per second the current drawn from the module 3 is only $5\times10^{-6}$ ampere, indicating an output power of only $5\times10^{-2}$ watt (50 milliwatts) when the high potential is $1\times10^{4}$ volts. At this low power, the useful life of the batteries 2 used to energise the module 3 may be hundreds of hours.

To maintain the field adjusting member 13 at low or zero potential, the earth lead 14 must contact actual ground or some other low voltage, high capacitance, body. For portable use of the spray gun shown in FIG. 1, it is sufficient to trail the earth lead 14 so that it touches the ground.

By varying the position of the dish 12 along the length of the distributor 7 the position of the field-adjusting member 13 may be adjusted with respect to the fixed postion of the capillary tubes 9 so as to achieve the best spray characteristics in accordance with the potential difference between the field adjusing member 13 and the capillary tubes 9, and other variables such as the electrical resistivity of the liquid.

The device shown in FIGS. 1 and 2 fulfils its purpose of producing spray having a reduced, or in some cases almost zero, charge, but is not easy to adjust. In an alternative form of nozzle illustrated in FIG. 3, an earthed metal field modifying member 20 carries three metal corona discharge needles 21. The shafts 22 of these needles 21 are threaded, and each shaft 22 carries a correspondingly threaded metal nut 23, having a U-shaped section. The nut 23 may be wound down the shaft 22 so that the ends of arms of the U are opposite the tip of the needle 21 (as shown in FIG. 4) or up the shaft 22 so that the tip of the needle 21 extends well beyond the arms of the U (as shown in FIG. 5); or to any intermediate position. With the nuts 23 in the position of FIG. 5, the shielding effect of the nuts 22 (sheath electrodes) on the needles 21 is negligible, and spray forming from the charged nozzle 19 is almost completely discharged by corona action as it passes the tips of the needles 21. With the nuts 23 in the position of FIG. 4, the shielding effect is substantially complete and little or no discharge of the spray takes place. By adjusting the position of the nuts 23 suitably between those shown in FIGS. 4 and 5 the degree to which the spray is discharged can be correspondingly varied.

Figure 3:
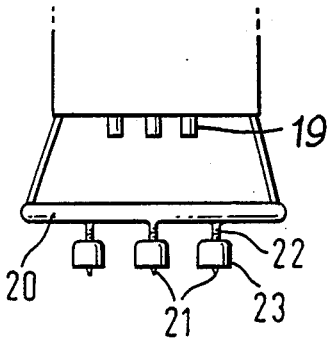
FIG. 3 is a side view of a nozzle and discharge needles with sheath electrodes.
Figure 4:
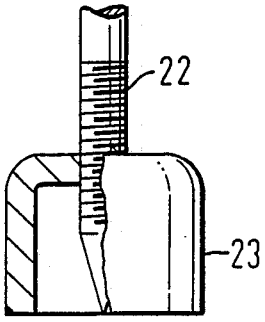
FIGS. 4 and 5 are elevation details (part cut away) of needles with sheath electrodes in weak field and strong field positions respectively.
Figure 5:
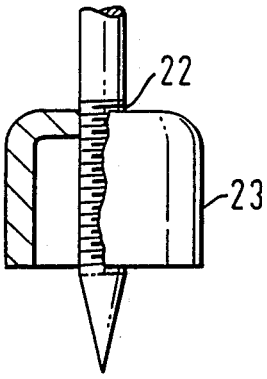
Figure 6:
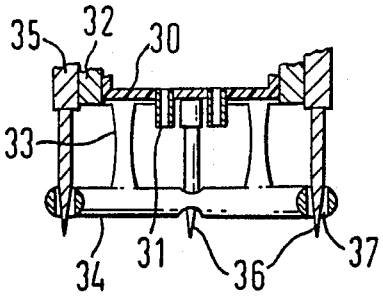
FIG. 6 is a section in elevation of a nozzle with an alternative system of sheath electrodes.

The apparatus of FIGS. 3–5 thus has the flexibility to produce both uncharged and highly charged spray, as desired. Each of the three nuts 23 has to be adjusted separately, however, which can be awkward in use. FIG. 6 is a section in elevation through an alternative sprayhead. The plastic tubular distributor 30 is formed with four metal capillary tubes 31 capable of connection to a source of high voltage. A push fit on the outside of the distributor 30 is an inner sleeve 32, carrying on struts 33 a metal field-adjusting ring 34, connected to earth. An outer sleeve 35 is a close fit over the inner sleeve 32; longitudinal grooves (not shown) on sleeve 35 mate with longitudinal ribs on sleeve 34 permitting sleeve 35 to move up and down but preventing it rotating relative to sleeve 34. From sleeve 35 four earthed metal needles 36 extend downwardly into bores 37 in the ring 34. In operation in the position shown in FIG. 6, liquid emerges from the charged capillary tubes 31, is drawn out into ligaments by the field between the tubes 31 and the earthed ring 34, and breaks up into highly charged droplets. The droplets pass out through the ring 34 and past the tips of the needles 36; on these they induce sufficient charge to cause an electric discharge at the points of the needles which considerably reduces the charge on the droplets. When desired, the sleeve 35 may be moved upwardly on sleeve 34 until the tips of the needles 36 are shielded within the bores 37 of the ring 34; operation of the sprayer then produces a highly charged spray.

Embodiments of the invention described above use three or four needles, more or less may be used if desired. Some degree of discharge of spray may be obtained from a single needle; for the fullest discharge of spray it may be desirable to use more than four. A spray nozzle in the form of a slit may require a dozen or more needles, regularly spaced; or alternatively, for such a nozzle, an earthed blade may provide a more suitable means of discharging the spray.

In the arrangements illustrated the needles are all regularly spaced around the path of the spray. It is not always necessary to do this. Asymmetrically placed needles can produce a partially discharged spray cloud in which the droplets have a range of charges. This may be useful in, for example, crop spraying, where the best distribution of spray through the crop might be obtained from a mixture of uncharged and highly charged droplets. A spray cloud of the same type may also be obtained using regularly spaced needles having adjustable sheath electrodes, by shielding some needles and not others.

Another method of controlling the degree to which the spray droplets are discharged is to include a large resistance between the needle electrodes and earth. This cuts down the induced discharge current taken by the electrode from earth, and hence the degree to which the spray cloud is discharged. If the large resistance is made variable, the degree of spray discharge is readily controlled. Where this is done, the needle electrodes need to be earthed separately from the field-adjusting electrode, or the atomising field will be weakened.

In certain circumstances it may be desirable to use other electrical devices (both active and passive) to limit the discharge current at the tips of the needle electrodes.

I claim:

1. A process for spraying liquid at a target, which comprises atomizing liquid by charging it electrostatically at a charged conductive surface, projecting the charged atomized liquid on a path toward the target and at least partially discharging the charged particles so formed with an ionic discharge induced by the particles as they pass an earthed electrode having a sharp or pointed edge sited adjacent said path and pointing away from said charged conductive surface.

2. A process as claimed in claim 1 in which the liquid is a pesticide.

3. Spraying apparatus for use in spraying liquid toward a target which comprises: means for supplying liquid to an atomisation site; means for charging the liquid at the site sufficiently to cause it to atomise into charged droplets and be projected on an outward path toward the target; and means for at least partially discharging the charged droplets on said outward path toward the target, said means including an earthed electrode having a sharp or pointed edge or edges adjacent to and directed toward or along said path and away from the atomisation site.

4. Apparatus as claimed in claim 3 including means adjacent the atomisation site to intensify the electrostatic field thereat, said means being constituted at least in part by said earthed electrode.

5. Apparatus as claimed in claim 3 in which the sharp or pointed edge or edges of the earthed electrode are provided with sheath electrodes which are at the same potential as the sharp or pointed edge or edges and which are adjustably mounted so as to be able to shield the sharp or pointed edge or edges to a greater or lesser extent.

6. Apparatus as claimed in claim 3 in which the earthed electrode is connected to earth via a high resistance.

7. Apparatus as claimed in claim 6 in which the resistance is variable.

8. Apparatus as in claim 3 including means adjacent the atomisation site to intensify the electrostatic field thereat, said means being constituted by a second earthed electrode.

* * * * *

UNITED STATES PATENT AND TRADEMARK OFFICE

CERTIFICATE OF CORRECTION

PATENT NO. : 4,962,885

DATED : 10/16/90

INVENTOR(S) : Ronald A. Coffee

It is certified that error appears in the above-identified patent and that said Letters Patent is hereby corrected as shown below:

On the title page please insert the following:

-- item [73] Assignee: Imperial Chemical Industries Limited--.

Signed and Sealed this

Eighth Day of September, 1992

*Attest:*

DOUGLAS B. COMER

*Attesting Officer*

*Acting Commissioner of Patents and Trademarks*